US008871042B2

(12) United States Patent
Milburn

(10) Patent No.: US 8,871,042 B2
(45) Date of Patent: Oct. 28, 2014

(54) HEAT TREATMENT APPARATUS AND A METHOD OF USING SUCH APPARATUS

(75) Inventor: Richard Gordon Milburn, Nottingham (GB)

(73) Assignee: Rolls-Royce PLC, London (GB)

( * ) Notice: Subject to any disclaimer, the term of this patent is extended or adjusted under 35 U.S.C. 154(b) by 297 days.

(21) Appl. No.: 13/493,441

(22) Filed: Jun. 11, 2012

(65) Prior Publication Data

US 2012/0326362 A1 Dec. 27, 2012

(30) Foreign Application Priority Data

Jun. 23, 2011 (GB) ..... 1110611.9

(51) Int. Cl.

| | |
|---|---|
| ***C21D 1/53*** | (2006.01) |
| ***C21D 9/00*** | (2006.01) |
| ***C22F 1/00*** | (2006.01) |

(52) U.S. Cl.

CPC ..... *C21D 1/53* (2013.01); *C21D 9/0068* (2013.01); *C22F 1/004* (2013.01)

USPC ..... 148/630; 266/172; 266/262

(58) Field of Classification Search

CPC ..... C21D 1/53; C21D 9/0068; C22F 1/004

USPC ..... 266/172, 249, 262; 148/630

See application file for complete search history.

(56) References Cited

U.S. PATENT DOCUMENTS 3,250,521 A * 5/1966 Sergent ..... 432/197

FOREIGN PATENT DOCUMENTS

| | | |
|---|---|---|
| JP | A-48-44109 | 6/1973 |
| JP | U-59-152395 | 10/1984 |
| JP | A-62-186188 | 8/1987 |
| JP | A-64-46576 | 2/1989 |
| SU | 705230 | 12/1975 |
| SU | 1000714 | 2/1983 |

OTHER PUBLICATIONS

Feb. 28, 2012 British Search Report issued in British Patent Application No. 1110611.9.

Oct. 14, 2011 British Search Report issued in British Patent Application No. 1110611.9.

* cited by examiner

*Primary Examiner* — Scott Kastler

(74) *Attorney, Agent, or Firm* — Oliff PLC

(57) ABSTRACT

A heat treatment apparatus 10 for heat treating metals or metallic components includes a fluidized bed furnace 20 and a removable insert 30 which is accommodated within the fluidized bed 50 of the furnace 20. The removable insert 30 enables the geometry of the fluidized bed 50 to be optimized with respect to the size and shape of a component 70 which is to be heated.

14 Claims, 1 Drawing Sheet

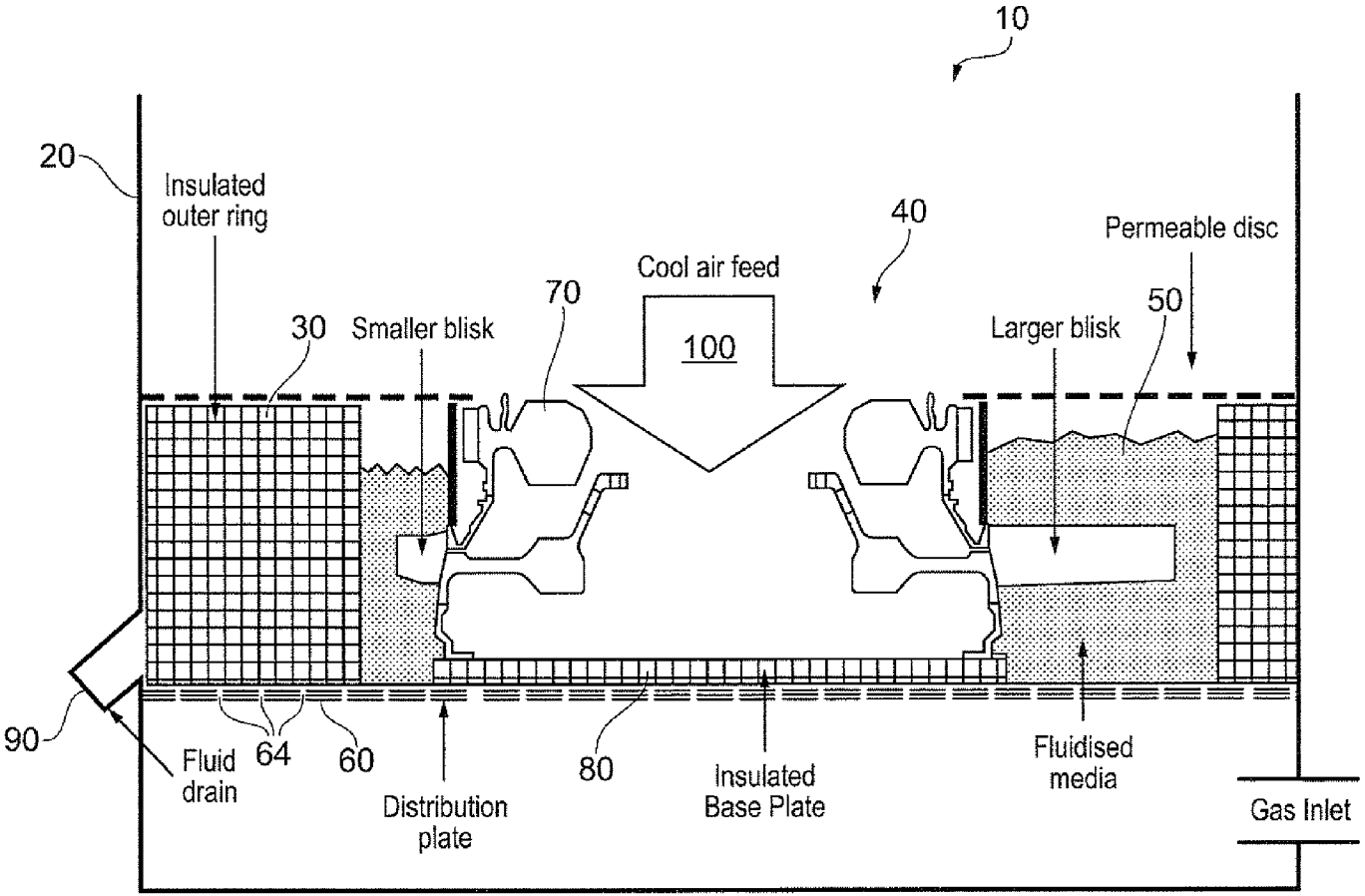
10
Permeable disc
50
Larger blisk
40
Cool air feed
100
70
Smaller blisk
30
Insulated outer ring
20
Gas Inlet
Fluidised media
Insulated Base Plate
80
Distribution plate
60
64
Fluid drain
90

HEAT TREATMENT APPARATUS AND A METHOD OF USING SUCH APPARATUS

This invention claims the benefit of UK Patent Application No. 1110611.9, filed on 23 Jun. 2011, which is hereby incorporated herein in its entirety.

FIELD OF THE INVENTION

This invention relates to a heat treatment apparatus and particularly, but not exclusively, to a heat treatment apparatus, comprising a fluidised bed, for selectively heat treating metallic components having a low aspect ratio.

BACKGROUND TO THE INVENTION

Heat treatment is used to change the mechanical properties, microstructure, and/or the residual stress state of metals or metallic components.

Traditional heat treatment techniques involve heating the component(s) either in a conventional air furnace or via gas jets. However, these techniques are inherently inefficient at transferring heat energy to the component(s).

This results in long cycle times due to the slow rate of heat transfer. In addition, the quality of the heat treatment is limited by the non-uniform heating of the component(s).

It is possible to overcome these disadvantages by using a fluidised bed furnace.

A fluidized bed is a bed of granular media that behaves like a fluid when a gas is passed through it. When employed in a furnace the medium is generally a refractory material, such as, for example, aluminium oxide.

The component to be heated is then submerged in the fluidised bed which is then heated.

By completely enveloping the component, the fluidized bed provides excellent heat transfer from the bed to the component being heated. For example a typical fluidised bed furnace has a heat transfer coefficient of approximately 390 $W/m^2/^\circ C.$, while a typical gas jet type heating process might have a heat transfer coefficient of approximately 120 $W/m^2/^\circ C.$

STATEMENTS OF INVENTION

According to a first aspect of the present invention there is provided a heat treatment apparatus comprising a fluidised bed furnace and a removable insert receivable within the furnace, wherein, when positioned within the furnace the insert defines a space which accommodates a fluidised bed.

The thermal cycle time and the operating cost of a fluidised bed furnace are a function of the volume of the fluidised bed and the construction of the furnace, and are relatively independent of the size of the component being heated.

The use of a removable insert enables the volume of the fluidised bed to be optimised relative to the size of the component being heated. Consequently, the furnace may be sized for the largest part which is required to be heated and one or more inserts may be used when heating smaller components so as to ensure that the volume of the fluidised bed is optimised.

By optimising the volume of the fluidised bed, it is possible to reduce the cost of operation of the furnace and lower the thermal cycle time when heating smaller components. This makes the furnace more convenient and cost-effective for the user.

A further advantage of lowering the thermal cycle time is that it allows for the furnace to be loaded and unloaded when the fluidised bed is close to room temperature without excessively prolonging the heat treatment cycle.

If the furnace is loaded with the fluidised bed at the heat treatment temperature, the turbulent nature of the surface of the bed results in air being entrained into the upper layer of the bed. This may cause formation of an undesirable oxygen-enriched phase at the surface of the component, such as, for example, alpha case in a titanium component.

Similarly, if the component is removed from the furnace while it is still at its heat treatment temperature, the exposure of the component to air may also result in the formation of the aforementioned oxygen-enriched surface layer.

Consequently, by loading and unloading the furnace at close to room temperature, the risk of such undesirable surface layers being formed in the components is minimised.

A further advantage of loading and unloading the furnace at close to room temperature is that it makes the process safer to use.

In order to avoid the formation of undesirable surface layers the loading and unloading temperature must be less than that at which exposure to air causes discolouration of the component's surface. For titanium components, this means loading and unloading the furnace when the temperature of the bed is below approximately 300° C.

Optionally, when in use, an article to be heat treated is positioned within the space, and the insert is sized such that a predetermined clearance is defined between the article and the insert.

The optimal size and volume of the fluidised bed in a fluidised bed furnace can be determined from the size and geometry of the part which is to be heated.

The optimised fluidised bed geometry should be such that a predetermined clearance is present around the component being heated.

Optionally, the insert is formed from a thermally insulative material.

The use of a thermally insulative material will reduce heat loss from the fluidised bed and will therefore improve the efficiency of the furnace.

Optionally, the insert extends around the inner periphery of the furnace.

In one embodiment of the invention the insert is formed as an annular ring which extends around the inner periphery of the furnace defining a central volume which accommodates the fluidised bed.

In other embodiments of the invention, the insert may comprise a plurality of inserts each of which are accommodated within the fluidised bed.

Optionally, the furnace further comprises a distribution plate having a plurality of apertures, the distribution plate being located in a base portion of the furnace and supporting the insert and the fluidised bed.

The distribution plate enables the fluidising gas to be supplied uniformly across the underside of the fluidised bed. It is this uniform distribution of the fluidising gas which helps to ensure the uniform temperature distribution within the fluidised bed.

The choice of fluidising gas is dictated by the reactivity of the material which is to be heated. For example, when heating titanium components it is necessary to use helium or argon in order to avoid the formation of undesirable surface layers.

However, another inert gas, such as, for example, nitrogen, may be used as a fluidising gas when heating steel components. For unreactive materials such as glass or ceramics, it is possible to use air as the fluidising gas.

Optionally, the furnace further comprises a gas permeable membrane covering the upper surface of the fluidised bed.

The use of an inert gas, such as nitrogen, as a fluidising gas results in the fluidised bed being substantially purged of air during normal operation.

However, it is known that, in use, the turbulent nature of the surface of the fluidised bed results in the atmosphere immediately above the bed being entrained by the bed media. Due to the circulatory movement of the fluidised bed media this entrainment can result in low concentrations of air being present throughout the bed. This can be a problem when heating certain metals, such as, for example, titanium.

By positioning a gas permeable membrane over the open surface of the fluidised bed it is possible to prevent the atmosphere immediately above the surface of the bed from being entrained by the bed media whilst still allowing the fluidising gas to escape from the bed.

Optionally, the membrane is a flexible membrane.

In one embodiment of the invention the membrane takes the form of a ceramic or Rockwool® mat.

Optionally, a thermally insulative layer is applied to a surface of the component which is in contact with the fluidised bed media.

When heat treating a component, it may be necessary to only heat certain parts or areas of the component to the desired temperature, whilst maintaining the remainder of the component below a predetermined temperature.

This may be achieved by covering or wrapping those parts of the component which are to be maintained below a certain temperature with a thermally insulative material.

In one embodiment of the invention this thermally insulative material is Superwool® Fibre felt (produced by The Morgan Crucible Company PLC).

Optionally, a cooling gas flow is directed at a portion of the component.

Where the component being heated has internal features which are to be protected from the heating effect of the fluidised bed, a directional airflow may be applied to maintain the temperature of these features below a predetermined value.

Optionally, the furnace further comprises an insulative supporting plate located between the article and the base of the furnace.

The use of an insulating base plate further limits the transfer of heat energy to portions of the component whose temperature is to be kept below a predetermined value. This allows the concentration of heat energy in those portions of the component which are to be heat treated, thus making the operation of the furnace more cost effective.

Optionally, the fluidised bed comprises a plurality of refractory particles, and the furnace further comprises a drain port adapted to allow for the drainage of the particles from the fluidised bed.

The use of a drain port enables the fluidised bed particles to be easily and conveniently removed from the furnace.

According to a second aspect of the present invention there is provided a fluidised bed furnace for the heat treatment of metals or metal articles, wherein the upper surface of the fluidised bed is covered by a gas permeable membrane.

Optionally, the membrane is a flexible membrane.

According to a third aspect of the present invention there is provided a method of using a heat treatment apparatus comprising a fluidised bed furnace and a removable insert receivable within the furnace; the method comprising the steps of:

placing an article to be heat treated in the furnace;

selecting an insert such that a pre-determined clearance is defined between the article and the insert;

placing the insert in the furnace;

filling the space defined between the article and the insert with a fluidised bed medium;

carrying out a pre-defined heat treatment process.

Optionally, the step of filling the space defined between the article and the insert with a fluidised bed medium, comprises the additional step of:

positioning a gas permeable membrane over the upper surface of the fluidised bed.

Other aspects of the invention provide devices, methods and systems which include and/or implement some or all of the actions described herein. The illustrative aspects of the invention are designed to solve one or more of the problems herein described and/or one or more other problems not discussed.

BRIEF DESCRIPTION OF THE DRAWINGS

There now follows a description of an embodiment of the invention, by way of non-limiting example, with reference being made to the accompanying drawings in which:

FIG. 1 shows a schematic sectional view of a heat treatment apparatus according to a first embodiment of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION

Referring to FIG. 1, a heat treatment apparatus according to a first embodiment of the invention is designated generally by the reference numeral 10. The apparatus 10 comprises a furnace 20 together with a removable insert 30 which is receivable within the furnace 20.

When positioned within the furnace 20, the insert 30 defines a space 40 which accommodates a fluidised bed 50. The fluidised bed 50 is comprised of a plurality of refractory particles, in the form of aluminium oxide.

Alternatively, any other refractory material in powdered form could be used to form the fluidised bed, provided that the refractory material did not react with the material forming the component which is to be heat treated. In the present embodiment, the refractory material could be any metal oxide where the metal is more reactive than titanium.

A distribution plate 60 is positioned within the base portion of the furnace 20 and extends beneath the insert 30. The distribution plate 60 comprises a plurality of perforations 64 which allow the fluidising gas to enter the fluidised bed 50.

The component 70 which is to be heated is then positioned within the space 40 and is supported by an insulated base plate 80. The component 70 is positioned such that there is a uniform clearance between the component 70 and the insert 30. The remaining volume of the space 40 is filled with refractory particles to form the fluidised bed 50.

When filling the fluidised bed 50, the refractory particles may simply be poured into the open space around the component 70.

A drain port 90 is provided in a side of the furnace 20 to allow the refractory particles to be drained from the furnace 20 on completion of the heat treatment cycle.

A cooling air supply (not shown) is arranged to supply a cooling air flow 100 to an interior portion of the component 70.

In use, the component 70 to be heated is positioned within the space 40 and the refractory particles are added to form the fluidised bed 50 when the furnace 20 is at room temperature.

The furnace 20 is then heated in accordance with the required heat treatment temperature profile.

During the heat treatment cycle, the cooling air flow 100 ensures that those portions of the component 70 which are not intended to be heat treated are kept below a predetermined temperature.

On completion of the heat treatment cycle, the fluidised bed 50 is allowed to cool to approximately room temperature. The refractory particles are then drained via the drain port 90 and the component 70 may then be removed from the furnace 20.

The above described apparatus and method have been described in relation to their application to the heat treatment of metals or metal articles. However, it is to be understood that the apparatus and method may also be applied to the heating of other materials.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person of skill in the art are included within the scope of the invention as defined by the accompanying claims.

What is claimed is:

1. A heat treatment apparatus comprising:

a fluidised bed furnace;

a removable insert receivable within the furnace; and a distribution plate having a plurality of apertures;

wherein when positioned within the furnace the insert defines a space which accommodates a fluidised bed, and the distribution plate is located in a base portion of the furnace and supports the insert and fluidized bed.

2. The apparatus as claimed in claim 1 wherein, the insert is configured to define a space to receive therein an article to be heat treated, and the insert is sized such that a predetermined clearance is defined between the article and the insert.

3. The apparatus as claimed in claim 1 wherein the insert is comprised of a thermally insulative material.

4. The apparatus as claimed in claim 1 wherein the insert extends around an inner periphery of the furnace.

5. The apparatus as claimed in claim 1, further comprising a gas permeable membrane covering the upper surface of the fluidised bed.

6. The apparatus as claimed in claim 5, wherein the membrane is a flexible membrane.

7. The apparatus as claimed in claim 1 wherein the furnace is configured to receive a cooling gas flow to direct the cooling gas at a portion of an article to be heat treated.

8. The apparatus as claimed in claim 1, further comprising an insulative supporting plate located between an article to be heat treated and the base of the furnace.

9. The apparatus as claimed in claim 1, the fluidised bed comprising a plurality of refractory particles, wherein the furnace further comprises a drain port adapted to allow for the drainage of the particles from the fluidised bed.

10. A heat treatment system comprising:

a fluidised bed furnace for the heat treatment of metals or metal articles, wherein an upper surface of the fluidised bed is covered by a gas permeable membrane; and a plurality of removable inserts, each of the plurality of removable inserts configured for removable insertion in the fluidised bed furnace, wherein one or more of the removable inserts are insertable in the fluidised bed furnace to heat differently sized components received therein.

11. The furnace as claimed in claim 10, wherein the membrane is a flexible membrane.

12. A method of using a heat treatment apparatus comprising a fluidised bed furnace and a removable insert receivable within the furnace, the method comprising:

placing an article to be heat treated in the furnace;

selecting an insert such that a pre-determined clearance is defined between the article and the insert;

placing the insert in the furnace;

filling the space defined between the article and the insert with a fluidised bed medium; and carrying out a pre-defined heat treatment process.

13. The method as claimed in claim 12 wherein filling of the space defined between the article and the insert with a fluidised bed medium further comprises:

positioning a gas permeable membrane over an upper surface of the fluidised bed.

14. The heat treatment system as claimed in claim 10, wherein the plurality of removable inserts comprises a plurality of differently sized removable inserts.

* * * * *